US009897414B2

(12) United States Patent
Nasef

(10) Patent No.: US 9,897,414 B2
(45) Date of Patent: Feb. 20, 2018

(54) FIREARM SIGHT SYSTEM

(71) Applicant: WrenTech Industries, LLC, Santa Fe, NM (US)

(72) Inventor: Richard Nasef, Santa Fe, NM (US)

(73) Assignee: WrenTech Industries, LLC, Santa Fe, NM (US)

( * ) Notice: Subject to any disclaimer, the term of this patent is extended or adjusted under 35 U.S.C. 154(b) by 0 days.

(21) Appl. No.: 15/167,560

(22) Filed: May 27, 2016

(65) Prior Publication Data

US 2016/0349009 A1 Dec. 1, 2016

Related U.S. Application Data

(60) Provisional application No. 62/168,264, filed on May 29, 2015.

(51) Int. Cl.
*F41G 1/01* (2006.01)
*F41G 1/02* (2006.01)
*F41G 1/10* (2006.01)

(52) U.S. Cl.
CPC ..... *F41G 1/01* (2013.01); *F41G 1/02* (2013.01); *F41G 1/10* (2013.01)

(58) Field of Classification Search
CPC ..... F41G 1/01; F41G 1/02; F41G 1/10
USPC ..... D22/108, 109
See application file for complete search history.

(56) References Cited

U.S. PATENT DOCUMENTS 6,360,471 B1 * 3/2002 Stein ..... F41G 1/01 42/122
6,711,846 B1 * 3/2004 Nasef ..... F41G 1/01 42/130
D489,115 S * 4/2004 Nasef ..... D22/109
D565,144 S * 3/2008 Price ..... D22/109
7,451,566 B1 * 11/2008 Price ..... F41G 1/01 42/111
D628,262 S * 11/2010 Ballard ..... D22/110
D634,807 S * 3/2011 Ballard ..... D22/110
7,934,334 B2 * 5/2011 Kraft ..... F41G 1/01 42/111

(Continued)

FOREIGN PATENT DOCUMENTS

FR 342645 A * 9/1904 ..... F41G 1/01
FR 2526933 A1 * 11/1983 ..... F41G 1/01
FR 2572802 A1 * 5/1986 ..... F41G 1/01

OTHER PUBLICATIONS

"Rear Sight V-Notch Blade", Jun. 2, 2009, shopruger.com.*

*Primary Examiner* — Stephen Johnson
*Assistant Examiner* — Joshua T Semick
(74) *Attorney, Agent, or Firm* — Banner & Witcoff, Ltd.

(57) ABSTRACT

A firearm and firearm sight system includes a rear sight that changes the image of the front sight, that is, what the operator observes when viewing the front sight through the rear sight. The rear sight accomplishes this front sight image change by obscuring portions of the front sight and its shape when the operator observes the front sight looking through the rear sight. This obscuring of the front sight results in the observance by the operator of a new front sight shape. The new front sight shape represents an aligned sight picture, meaning the new front sight shape indicates the firearm sights are correctly aligned on the firearm and can then be aligned with the intended target.

20 Claims, 5 Drawing Sheets

(56) References Cited

U.S. PATENT DOCUMENTS

| | | | | |
|---|---|---|---|---|
| 7,946,075 | B2 * | 5/2011 | Nasef | H02G 3/0493 42/141 |
| D726,865 | S * | 4/2015 | Nasef | D22/109 |
| 9,360,278 | B2 * | 6/2016 | Mansfield | F41G 1/345 |

* cited by examiner

FIREARM SIGHT SYSTEM

CROSS-REFERENCE TO RELATED APPLICATION

This application claims priority to U.S. Provisional Application Ser. No. 62/168,264, filed on May 29, 2015, which is incorporated by reference in its entirety.

FIELD OF THE INVENTION

The present invention relates generally to firearms and iron sights used with firearms, and more particularly to an improved firearm sight system.

BACKGROUND

It is known that iron sights are used on firearms to assist the operator in aligning the firearm with the intended target. Typically, this includes the alignment of the rear sight with the front sight and then with the intended target. It also known that at all stages of sight alignment for current sight applications, the front sight and rear sight geometries as observed by the operator remain unchanged.

There remains a need in the art to improve the rapid alignment of the front and rear sights with the intended target to create a more accurate and consistent alignment with the target.

SUMMARY

The present invention relates generally to firearms and sights used with firearms, such as, rifles, carbines, pistols, shotguns, hand guns, long guns, and the like, and more particularly to an improved firearm rear sight that obscures any portion of any front sight to create a new front sight geometry observed by the operator that then represents an aligned sight picture. In other words, the firearm sight system of the disclosed embodiments includes a rear sight that changes the image of the front sight, i.e., what the operator observes when viewing the front sight through the rear sight. The rear sight accomplishes this front sight image change by obscuring portions of the front sight and its shape when the operator observes the front sight looking through the rear sight, thereby resulting in the observance of a new front sight shape or geometry. For instance, the front sight may define the shape of an irregular shaped pentagon, but when the irregular shaped pentagon is viewed through the rear sight the irregular shaped pentagon is seen as the shape of a diamond. This change in appearance results from the rear sight, and its particular configuration, obscuring portions of the front sight when the operator is viewing the front sight through the rear sight. From a firearm alignment standpoint, once the diamond shape is observed through the rear sight, the operator knows that the rear and front sights are properly aligned and thus the firearm is properly aligned. The operator then simply needs to align the top-most point of the diamond on the intended target and the firearm becomes properly aligned with the target.

The invention provides several advantages over conventional front and rear sights. As an example, the invention provides quicker target acquisition, greater target area visibility, precision accuracy in all lighting conditions, and customizable sight schemes.

BRIEF DESCRIPTION OF THE DRAWINGS

The present invention is illustrated by way of example and not limited in the accompanying figures in which like reference numerals indicate similar elements and in which.

DESCRIPTION OF THE EMBODIMENTS

Referring to the Figures, there are depicted exemplary embodiments of a firearm and a firearm sight system that includes a rear sight that obscures and changes the observed image of the front sight when the operator observes the front sight looking through the rear sight. The resulting change in the appearance of the front sight geometry to a desired geometry (for example, a diamond shape) indicates that the rear and front sights are properly aligned on the firearm. The embodiments of the invention are intended to cover any rear sight obscuring of the front sight shape that results in a different and particular front sight shape indicating that the rear and front sights are aligned. It should be understood that the exemplary embodiments may be used with any type of firearm, including, without limitation rifles, carbines, pistols, shotguns, handguns, long guns, and the like, including any models of the foregoing. The concepts of the disclosed embodiments may also have application beyond the use on firearms and may be applied to any other structure, device or item where a first end needs to be aligned with a second end and both ends then need to be aligned to a desired target or object that is distant from the first and second ends.

Figure 1:
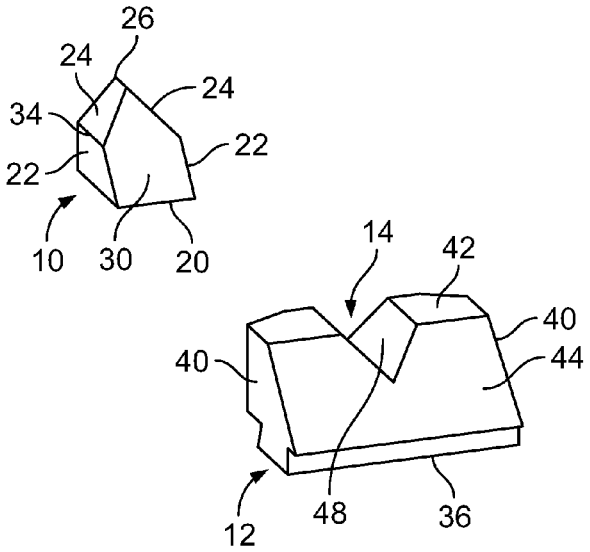
FIG. 1 is an isometric view of an exemplary front and rear sight of an embodiment of the invention.
Figure 2:
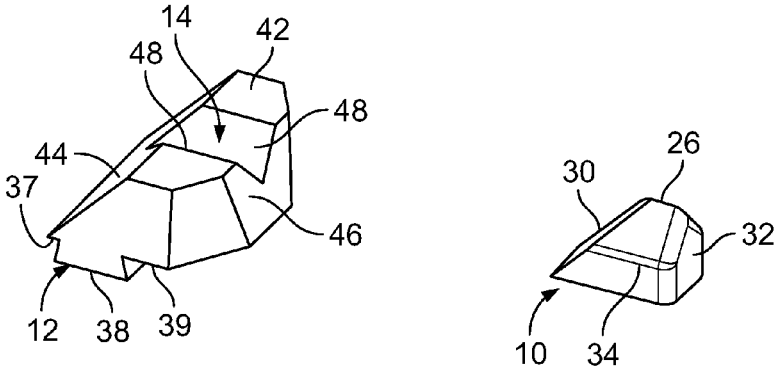
FIG. 2 is another isometric view of the embodiment of FIG. 1.
Figure 3:
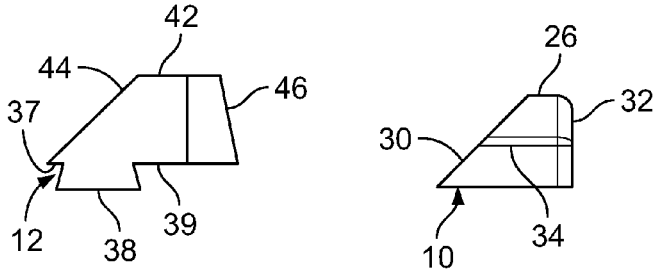
FIG. 3 is a side view of the embodiment of FIG. 1.

In an exemplary embodiment, and referring to FIGS. 1-3, a front sight 10 may define in an exemplary aspect an irregular shaped pentagon. The front sight may be mounted to any type of firearm. A rear sight 12 includes a body that defines a v-notch 14 located on the top of the rear sight body. The rear sight may also be mounted to any type of firearm.

More particularly, in an exemplary embodiment, the front sight 10 may define a rectangular base 20. Upwardly extending side walls 22 may be on opposite sides of the base. Extending angularly and upwardly from the side walls are angled top surfaces 24 that join at an apex 26. The apex 26 is the top-most point of the front sight. The angled top surfaces 24 may extend at any number of possible angles and yet join to form an apex. The formed apex may be a line formed by the edges of the top surfaces 24, as shown in FIG. 1. Alternatively, the apex 26 may be a point formed by the convergence of the top surfaces 24 at a point. In either embodiment, the apex 26, when viewed through the rear sight, will appear as a point, which in use is the aimpoint for the front sight. The operator of the firearm will position the aimpoint or apex 26 on the intended target.

The front sight may also include a front surface 30 and a rear surface 32. In one embodiment, the front surface 30 may define an angularly extending, planar surface that defines a top-most point at the apex 26. The front surface 30 may also extend more vertically from the base 20. In an exemplary embodiment, the front surface 30 defines an irregular shaped pentagon. This irregular shaped pentagon is formed by the base 20, the opposing and upwardly extending side walls 22, and the angled top surfaces 24 that join at the apex 26. The rear surface may also define an irregular shaped pentagon. This surface is also formed by the base 20, the opposing and upwardly extending side walls 22, and the angled top surfaces 24 that join at the apex 26.

In an exemplary aspect, where the side walls 22 join with the top surfaces 24, the front sight may include an undercut 34 that extends along the line formed where the side walls and top surfaces join. The undercut 34 will create the appearance of an overhang between the top surfaces 24 and the side walls 22. The undercut 34 will also give the appearance of a sharp transition between the top surfaces and the side walls. When viewing the front sight from the front surface, this sharp transition formed by the undercut gives the appearance of a distinctive edge. This distinctive edge of the top surfaces 24 will assist the operator to visually observe the distinctive diamond shape formed when the front sight is aligned with the rear sight and the operator is observing the front sight through the rear sight, as explained more fully below. More importantly, this distinctive edge will allow the operator to more quickly observe the formed diamond shape after the front and rear sights are properly aligned. This will permit the operator of the firearm to more quickly align the sights and then align the sights with the intended target. In one embodiment, the undercut 34 may form a downwardly and angularly extending surface that matches the angle of the v-notch 14 formed in the rear sight. This matching of the angular surface of the undercut 34 with the angle of the v-notch 14 will further assist in allowing the operator to more quickly form the distinctive diamond shape when aligning the front and rear sights, thereby improving the speed at which the sights are aligned with the intended target.

Figure 8:
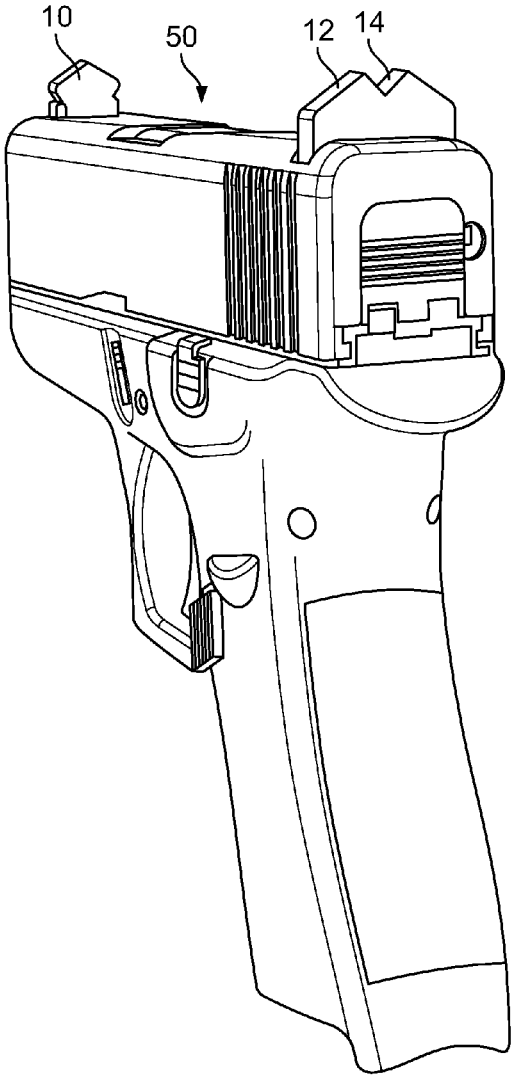
FIG. 8 is a perspective view of the exemplary firearm of FIG. 7 illustrating the exemplary front and rear sights moving closer to alignment.
Figure 9:
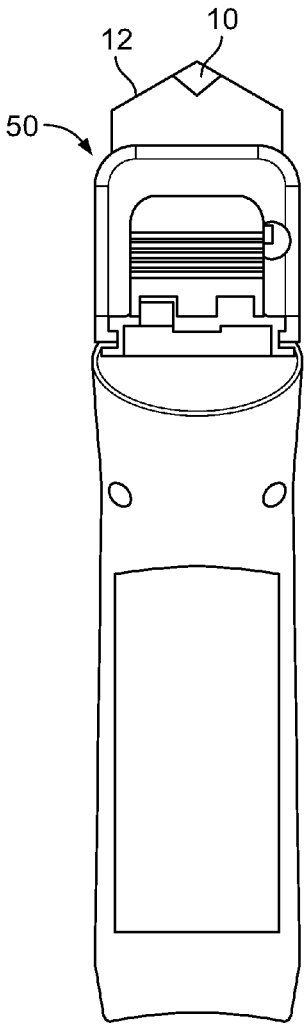
FIG. 9 is an end view of the exemplary firearm of FIG. 7 illustrating the exemplary front and rear sights in alignment.
Figure 10:
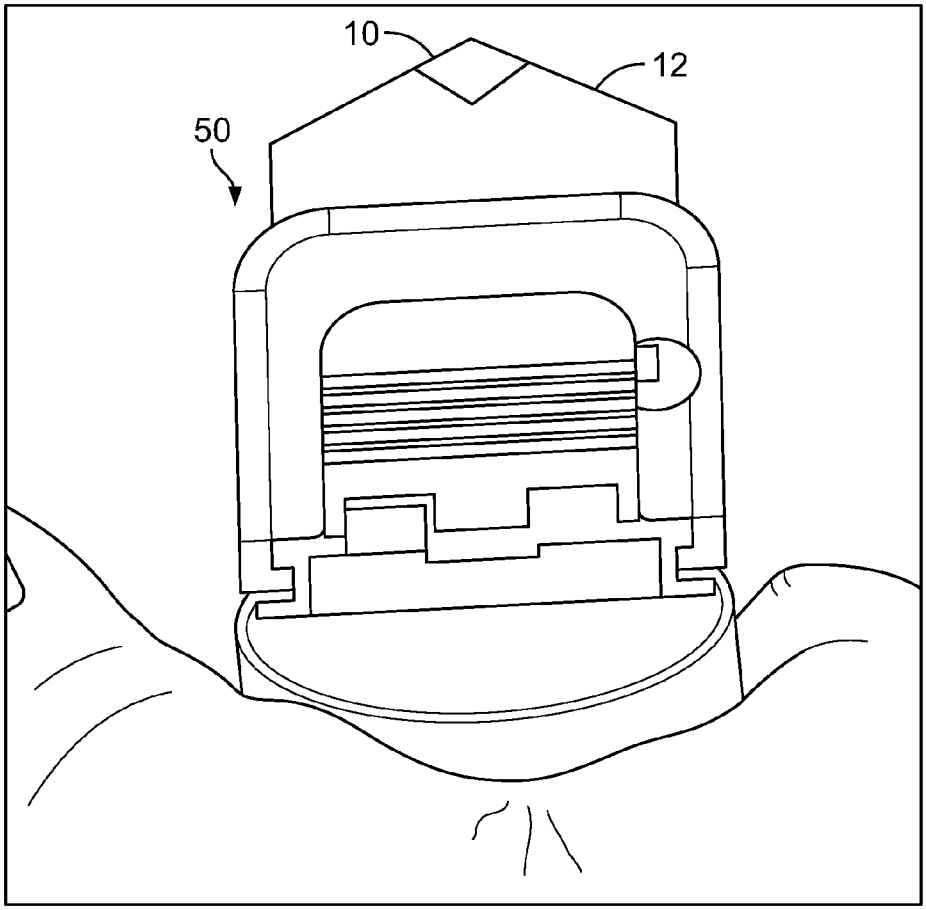
FIG. 10 is a close-up view of the exemplary front and rear sights in proper alignment.

In an exemplary embodiment, the rear sight 12 may define a base 36 that forms several base surfaces 37, 38, 39. The base surfaces may be used to mount the rear sight to the firearm and align and more securely hold the rear sight onto the firearm. The base surfaces may define numerous possible shapes and configurations depending on the type of firearm to which the rear sight is mounted. Opposing side walls 40 may extend upwardly from the base. The side walls 20 may terminate at top surface 42. In an exemplary embodiment, the top surface 42 may define a flat, planar surface that extends parallel to the base surfaces. In an alternative embodiment, the top surface 42 may define a pair of surfaces located on both sides of the v-notch 14 that extend angularly downward away from the v-notch, as depicted in FIGS. 8 and 9. The top surface 42 is the top-most portion of the rear sight.

Extending angularly and upwardly from the base is a rear sight front face or surface 44 that joins with the top surface 42. The front face or surface 44 of the rear sight may extend at any number of possible angles and yet join with the top surface. The front face or surface 44 of the rear sight is used to obscure or block features of the front sight when the operator views the front sight through the rear sight. In one embodiment, the front face or surface 44 defines a planar, black surface that has a shape defined by the side walls and the top surface. The size of the front surface may vary depending on the desired amount of obscuring required of the front sight. In an exemplary aspect, the size of the front surface is large enough to obscure the entirety of the front sight, except for the formed diamond shape that appears through the v-notch when the front and rear sights are properly aligned. In other embodiments, the front surface of the rear sight may obscure less than the entirety of the front sight even after the formed diamond shape appears through the v-notch. In this embodiment, additional or different sight picture shapes are formed that may be indicative of the front and rear sights being properly aligned.

Extending upwardly from the base is a rear surface 46 that joins with the top surface 42. The rear surface 46 may extend vertically or at any number of possible angles and yet join with the top surface. The rear surface 46 may define several beveled surfaces, as illustrated in FIG. 2.

Figure 6:
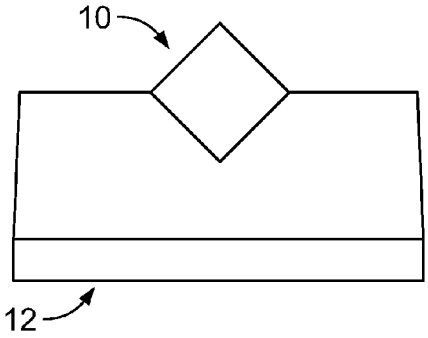
FIG. 6 is a front view of the embodiment of FIG. 4 with the front and rear sights properly aligned.

Formed within the top surface and extending down along the front surface is the v-notch 14. In an exemplary embodiment, the v-notch 14 is centered laterally along the top surface when viewing the v-notch from the front surface 44. The v-notch 14 may be cut-out or recessed from the top surface. The v-notch 14 may define angled surfaces 48 that merge or join to give the appearance of a v-shape. The angle of the surfaces 48 in relation to the top surface may vary depending on the desired amount of obscuring of the front sight by the rear sight front surface 44. In an exemplary embodiment, in relation to a horizontal plane, the angle of the surfaces 48 may match the angle of the top surfaces 24 of the front sight. This will create the appearance of an even sided diamond shape, as illustrated by FIG. 6. The angle of the surfaces 48 may also match the angle of the undercut 34 formed in the front sight. As indicated above, this angle matching will allow the operator to more quickly form the diamond shape and thus align the front and rear sights. The cut-out or recess that defines the v-shape 14 may extend any desired depth into the rear sight. In one embodiment, the cut-out or recess may extend downwardly approximately 25% of the height of the front sight. In another embodiment, the cut-out or recess may extend downwardly approximately 33% of the height of the front sight. In yet another embodiment, the cut-out or recess may extend downwardly approximately 50% of the height of the front sight. The amount of obscuring of the front sight by the rear sight will vary depending on the amount the cut-out extends downwardly.

In alternative embodiments of the rear sight, the angled surfaces 48 may define planar surfaces or may define non-planar surfaces. The surfaces 48 may be less than or more than the two depicted surfaces. The surfaces may be three or more surfaces that define numerous other possible shapes. The recess or notch 14, therefore, may define numerous other possible shapes and configurations. As explained below, these other possible shapes will create different sight pictures of the front sight. That is, these other possible shapes of the cut-out, along with the front surface 44 which obscures the front sight, will create other possible front sight geometries, which will be indicative of the front and rear sights being properly aligned.

Figure 4:
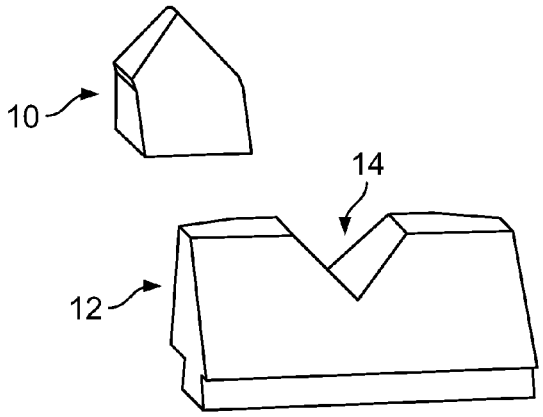
FIG. 4 is an isometric view of an exemplary front and rear sight of the invention.
Figure 5:
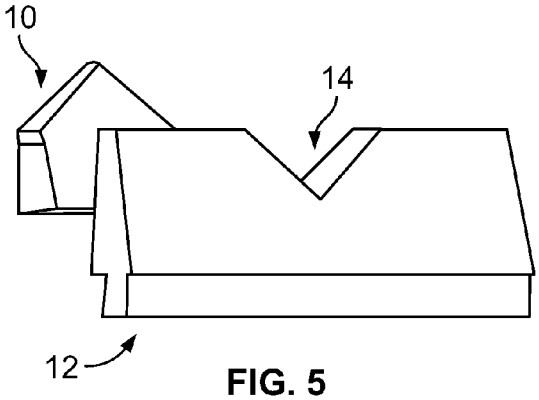
FIG. 5 is another isometric view of the embodiment of FIG. 4 with the front and rear sights moving closer to alignment.

Referring to FIGS. 4-6, when the irregular shaped pentagon front sight 10 is moved into alignment with the rear sight such that front sight is placed into and aligned with the v-notch 14 of the rear sight 12, so that the two angled top surfaces of the irregular pentagon align with the top of the v-notch, a diamond shape is created and observed by the operator, as depicted in FIG. 6. The created diamond shape is the aligned sight picture, meaning that when the diamond shape is formed, the front and rear sights are properly aligned on the firearm. Once the top-most point or apex 26 on the diamond shape is aligned with the intended target, the firearm is then aligned with the target. In other words, and as depicted in the drawings, the function of the rear sight is to obscure portions of the front sight, thereby altering the geometry of the front sight, in the case of the shown exemplary embodiment, from a first perceived shape, such as an irregular shaped pentagon, to a second perceived shape, such as a diamond shape. The second or newly formed shape (e.g., a diamond shape) of the front sight is the geometry that then represents an aligned sight picture.

The front and rear sights may define different colors to further enhance the sight alignment. That is, the rear sight may be a first color, while the front sight may be a second color. The different colors assist the operator in visually aligning the sights more consistently and more rapidly. Any and all colors may be used with the sights of the disclosed embodiments depending on the operator's preferences. In one embodiment, the front sight may be a bright color or an illuminating color, while the rear sight may be black. During nighttime or dark conditions, the bright color front sight will appear as an irregular pentagon shape but then becomes a diamond shape when the front sight is properly aligned with the rear sight. The black color rear sight will assist with the quick alignment of the sights because the black color will make the bright color front sight stand out more during nighttime or dark conditions. In use in dark or night conditions, and as indicated above, to align the firearm with the intended target, the operator simply needs to place the top-most point of the front sight on the intended target and once the irregular pentagon shape changes to the diamond shape when viewing the front sight through the rear sight, the firearm is properly aligned with the target.

In an alternative aspect, the front and/or rear sight may also glow in the dark or otherwise illuminate in the dark if first exposed to light. For example, the front and/or rear sight may include fluorescent materials or polymers, such as, fluorescent solid, translucent and transparent materials. The sights may also be made of glow-in-the dark plastics or fiber optic materials. The sights may be made of any number of bright colors or color combinations. Still other means for enhancing the visibility and appearance of the front and rear sights are possible with the embodiments of the invention. In an exemplary and more preferred embodiment, the front sight may define a bright or illuminated color and the rear sight may define a black color. In this embodiment, the front sight will be more pronounced and will stand out more clearly for the operator during sight alignment, thereby allowing the operator to more quickly align the front and rear sights.

Referring to FIGS. 7-10, the exemplary embodiments are depicted mounted to a top surface of an exemplary firearm 50. The firearm 50 may be the depicted handgun, or may be any of the numerous known handgun models. The exemplary firearm 50 may include a frame 52, a hand grip 54 mounted to the frame, a trigger assembly 56 mounted to and within the frame, a barrel 58, and a top slide 60 movable in relation to the frame for charging the firearm. As stated previously, the exemplary embodiments may also be used with rifles, carbines, pistols, shotguns, long guns, and the like. The front sight 10 and rear sight 12 are capable of being mounted to or mountable to the top of the handgun. The front and rear sights are also detachable from the firearm. The front and rear sights may be adjusted for elevation and windage by adding or subtracting shims of different thicknesses which are placed under the base of each sight. Examples of adjustable front and rear sights and elevation and windage adjustment techniques that may be used with the exemplary embodiments of the invention are described in U.S. Pat. No. 7,946,075, which is commonly owned by the applicant. In one embodiment, the sights are attached to the top slide of the handgun and will travel with the slide when the operator charges the handgun.

Figure 7:
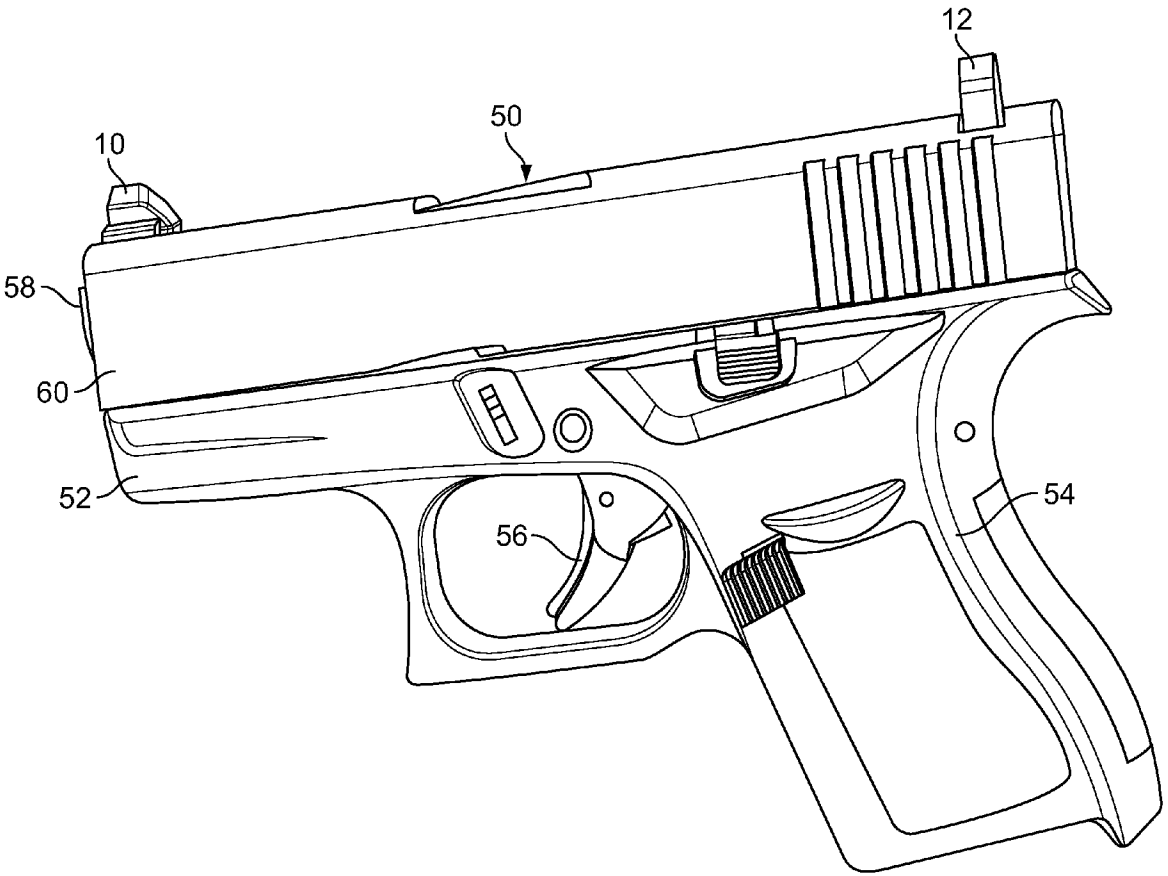
FIG. 7 illustrates the mounting of an exemplary embodiment on an exemplary firearm.

As can be seen when comparing FIGS. 7 and 8, when the irregular shaped pentagon front sight 10 is moved into alignment with the rear sight 12 such that the front sight is placed into and aligned with the v-notch 14 of the rear sight 12, so that the two horizontal angles of the irregular pentagon align with the top of the v-notch, a diamond shape is created and observed by the operator, as depicted in FIG. 8. The formed diamond shape is the result of the rear sight obscuring portions of the front sight. The formed diamond shape is the aligned sight picture which means the front and rear sights are properly aligned on the firearm. To align the firearm 50 with the intended target, the operator only needs to align the top-most point on the diamond shape with the target. Due to the shape of the formed diamond shape greater target area visibility is achieved because less target area is obscured by either the front or rear sights. This provides for greater speed with target acquisition and greater accuracy with both short range and long range shooting.

It should be understood that the front and rear sight geometries depicted in the figures are merely exemplary and the present invention is not limited to the depicted geometries. While one possible embodiment has the irregular pentagon shape front sight changing to the diamond shape when the sights are properly aligned, numerous other geometries are possible and are contemplated with the invention. For example, a formed geometry could be a tear drop shape, triangle, circle, arrow, oval, polygon, or any other desired shape. It should be understood by one of skill in the art that the scope of the invention includes any front and rear sight where the rear sight alters the geometry or shape of the front sight to create an aligned sight picture. The altered front sight represents the aligned sight picture, meaning the altered front sight geometry indicates the firearm sights are correctly aligned on the firearm and can then be aligned with the intended target.

It is to be understood that the invention is not limited in its application to the details of construction and the arrangement of the components set forth herein and illustrated in the drawings. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention.

What is claimed is:

1. A firearm sight system comprising:

a front sight mountable to a firearm, the front sight defining a front sight base, a pair of front sight opposing side walls, a front sight front face defined in a single plane and further defining a first shape, and a pair of angled top surfaces that join to define a top-most point, and a rear sight mountable to the firearm, the rear sight defining a rear sight base, a pair of opposing rear sight side walls, a rear sight front face, a rear sight top surface, and an angled notch formed in the rear sight top surface, the rear sight front face obscures a portion of the front sight front face to create a front sight front face that defines a second shape, wherein the second shape is different than the first shape, and wherein when the second shape is formed the second shape indicates that the front and rear sights are properly aligned.

2. The firearm sight system of claim 1, wherein the angled notch defines a v-shape.

3. The firearm sight system of claim 2, wherein the first shape defines an irregular shaped pentagon.

4. The firearm sight system of claim 3, wherein the second shape defines a diamond shape.

5. The firearm sight system of claim 2, wherein the irregular shaped pentagon is formed by the front sight base, the front sight opposing side walls, and the pair of angled top surfaces that join to define the top-most point.

6. The firearm sight system of claim 5, wherein the irregular shaped pentagon defines an undercut that extends along a line formed where the front sight opposing side walls and angled top surfaces join.

7. The firearm sight system of claim 6, wherein the undercut creates an overhang between the angled top surfaces and the front sight opposing side walls.

8. The firearm sight system of claim 7, wherein the undercut may form a downwardly and angularly extending surface that matches the shape of the angled notch in the rear sight.

9. The firearm sight system of claim 1, wherein the rear sight top surface defines a planar surface.

10. The firearm sight system of claim 9, wherein the rear sight front face extends angularly and upwardly from the rear sight base to the rear sight top surface.

11. A firearm defining a hand grip, a barrel, a frame and a top surface, the firearm sight system of claim 1 mounted to the top surface of the firearm.

12. A firearm sight system comprising:

a front sight capable of being mounted to a firearm, the front sight forming a first shape that is defined by a front sight base, a pair of front sight opposing side walls, and a pair of top surfaces that join to define a top-most point, the front sight including a front sight front face, and a rear sight capable of being mounted to the firearm, the rear sight defining a rear sight base, a pair of opposing rear sight side walls, a rear sight front face, a rear sight top surface, and a cut-out formed in the rear sight top surface, the rear sight front face obscures a portion of the front sight to create a front sight that defines a second shape, wherein the second shape is different than the first shape, and wherein when the second shape is formed the second shape indicates that the front and rear sights are properly aligned.

13. The firearm sight system of claim 12, wherein the cut-out defines a v-shape.

14. The firearm sight system of claim 12, wherein the first shape defines an irregular shaped pentagon.

15. The firearm sight system of claim 14, wherein the second shape defines a diamond shape.

16. The firearm sight system of claim 14, wherein the irregular shaped pentagon defines an undercut that extends along a line formed where the front sight opposing side walls and top surfaces join.

17. The firearm sight system of claim 16, wherein the undercut creates an overhang between the top surfaces and the front sight opposing side walls.

18. The firearm sight system of claim 17, wherein the undercut may form a downwardly and angularly extending surface that matches the shape of the cut-out in the rear sight.

19. The firearm sight system of claim 15, wherein the rear sight defines a black color, and the front sight defines a non-black color.

20. A firearm defining a hand grip, a barrel, and a top surface, the firearm sight system of claim 12 mounted to the top surface of the firearm.

* * * * *